US005567038A

United States Patent [19]

Lary

[11] Patent Number: 5,567,038

[45] Date of Patent: Oct. 22, 1996

[54] CAP WITH REMOVABLE FLUORESCENT LIGHT

[76] Inventor: Banning G. Lary, 6370 SW. 87th Ter., Miami, Fla. 33143

[21] Appl. No.: 402,860

[22] Filed: Mar. 13, 1995

[51] Int. Cl.[6] ..... F21L 15/14

[52] U.S. Cl. ..... 362/106; 362/396; 362/191; 362/293; 362/260; 2/209.13; 2/175.1; 2/906

[58] Field of Search ..... 362/105, 106, 362/396, 190, 191, 293, 260; 2/209.13, 175.1, 906

[56] References Cited

U.S. PATENT DOCUMENTS

| | | | |
|---|---|---|---|
| 3,331,958 | 7/1967 | Adler | 362/260 |
| 3,346,153 | 10/1967 | Galasso . | |
| 4,406,040 | 9/1983 | Cannone | 362/396 |
| 4,593,683 | 6/1986 | Blaha | 362/106 |
| 4,991,068 | 2/1991 | Mickey | 362/106 |
| 5,363,291 | 11/1994 | Steiner | 362/191 |
| 5,386,592 | 2/1995 | Checkeroski | 362/105 |
| 5,412,545 | 5/1995 | Rising | 362/105 |

*Primary Examiner*—Denise L. Gromada
*Assistant Examiner*—Sara Sachie Raab
*Attorney, Agent, or Firm*—Michael E. Klicpera

[57] ABSTRACT

The present invention pertains, generally, to the lighting of darkened areas. More particularly, it pertains to a light removably affixed to a cap worn on the head which permits the wearer to see and perform functions in the dark with both hands free. More particularly, it is a fluorescent light on a cap which light is detachable for placement to another site.

6 Claims, 1 Drawing Sheet

CAP WITH REMOVABLE FLUORESCENT LIGHT

BACKGROUND OF THE INVENTION

The invention relates generally to a light on a cap which illuminates dark areas and permits freedom of both hands and feet to perform various actions with greater efficiency and safety.

Illumination by lighting apparatuses attached to a hat have long been used by mankind to improve his efficiency. Goya, in the 17th Century, placed candles around the hatband to achieve a flickering light which gave an effect he sought to transfer to his paintings. The common miner's hat of the Industrial Revolution made extensive use of the carbide lamp attached to the hat for working in mineral mines and for cave explorations as well. The dry cell battery, the rechargeable, and lithium batteries are currently used in various types of headlights, which are usually spotlights. Such lights are frequently attached to hard hats and to various devices which encircle the head in a band-like fashion. These lights generally have a relatively narrow beam of the flashlight type, which beams can be focused to a given area by a reflector and a focusing lens. This limitation of general illumination of a wide area is characteristic of such headlighting apparatuses. In addition if one wishes to place the light in another location the supporting member must be removed from the subject.

Related applications can be found in the following cross references:

| U.S. PATENT DOCUMENTS | | |
|---|---|---|
| 3,346,153 | 10/67 | Galasso |
| 4,406,040 | 9/83 | Cannone |
| 4,593,683 | 6/86 | Blaha |
| 4,991,068 | 2/91 | Mickey |

SUMMARY OF THE INVENTION

The current invention utilizes the common baseball-type hat, to which is attached a fluorescent light. It is the object of this invention to provide an efficient lighting apparatus which embodies the principles of an adjustable cap worn on the head, to which a battery-powered fluorescent lighting apparatus is attached by the hook and loop concept. The fluorescent light requires a smaller amount of electrical current and illuminates a larger area with a softer light than the customary headlight.

The design of the apparatus permits diverse tasks to be easily performed, and increases the safety of all movements in the dark. It is particularly advantageous to pilots of aircraft and engineers to illuminate instrument panels in emergency situations when darkness prevails. Applications can be found anyplace a light is beneficial for convenience and pleasure.

It is further the object of this invention to permit easy removal of the fluorescent light for illumination in a stand-alone mode or with an additional attachment mechanism. A further object of the invention is to permit the attachment of various semi-transparent lens covers to change the color and/or decrease the intensity of the illumination. For example, a red plastic transparent lens cover may be attached to prevent loss of night vision. A further object is to permit the light to be elevated for diffuse illumination of a specific area, or concentrated to a smaller area closer to the operator, such as when examining a specific object or reading.

DESCRIPTION OF THE PREFERRED EMBODIMENT

Figure 1:
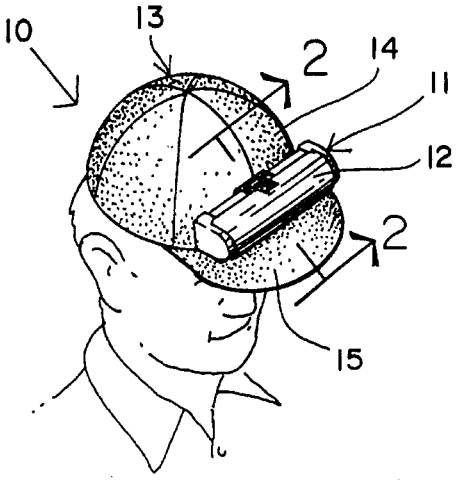
FIG. 1 illustrates the apparatus 10 consisting of an adjustable cap 13 with a removal fluorescent light fixture 11, to which may be attached a transparent plastic shield 12. The light is attached to the crown 14 and bill 15 of the cap by segments of hooks and loops.

The novel features of this invention, as well the invention itself, both as to its structure and its operation, will best be understood by the accompanying drawings, taken in conjunction with the accompanying description in which similar reference characters refer to similar parts, and in which:

FIG. 1 illustrates the device 10 which is an adjustable cap 13, to which is attached a fluorescent light 11. A transparent colored shield 12 is removably attached to the body of the light 11. The light 11 with the affixed shield 12 are attached to a part of the crown 14, the bill 15 of the cap 13.

Figure 2:
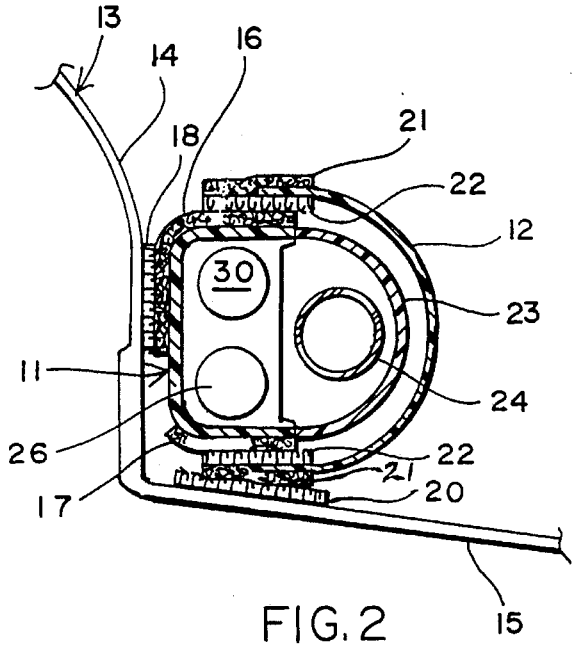
FIG. 2 illustrates the method of removably joining the three major components of the apparatus 10.

FIG. 2 illustrates in more detail the method for attaching the light 11 to the crown 14 and the bill 15 of the cap 13. Flexible segments of loops 16 are adhesively attached to part of the top and back of the light 11. Similarly, additional segments of loops 17 are attached to the bottom of the light 11.

The loops 16 attach to the hooks 18 sewn to the crown 14 of the hat 13 and the segment of loops 17 attach to the segment of hooks 20 sewn to the bill 15 of the cap 13.

FIG. 2 also illustrates segments of loops 21 adhesively attached to a portion of the center area of the top of the shield 12. These loops being of softer consistency then hooks, serve as a convenience in the attachment and detachment if the shield 12 to the body of the light 11. Directly opposing the loops 21 and attached partially to both the adhesive backing of loops and the shield is found a segment of hooks 22 which engage the segment of loops 16 and 17 on the light 11.

Further study of FIG. 2 will reveal the segment of loops 16 and 17 engage the segment of hooks 22 and the segment of loops 21 engage the segment of hooks 20, thus securing the shield 12 to the body of the light 11 and to the bill 15 of the cap 13. The segment of loops 21 is of small thickness and of limited length, so that it has minimal interference with the attachment of the segment of loops 17 to the segment of hooks 20. It will be observed that when the subject uses pressure on the light 11 to release the loops 16 from the hooks 18, the bill 15 of the cap 13 is deflected downward and greater illumination of proximal objects is achieved.

Further illustrated in FIG. 2 it will be observed that the light 11 is composed of a transparent lens 23, a fluorescent bulb 24, and batteries 26

Figure 3:
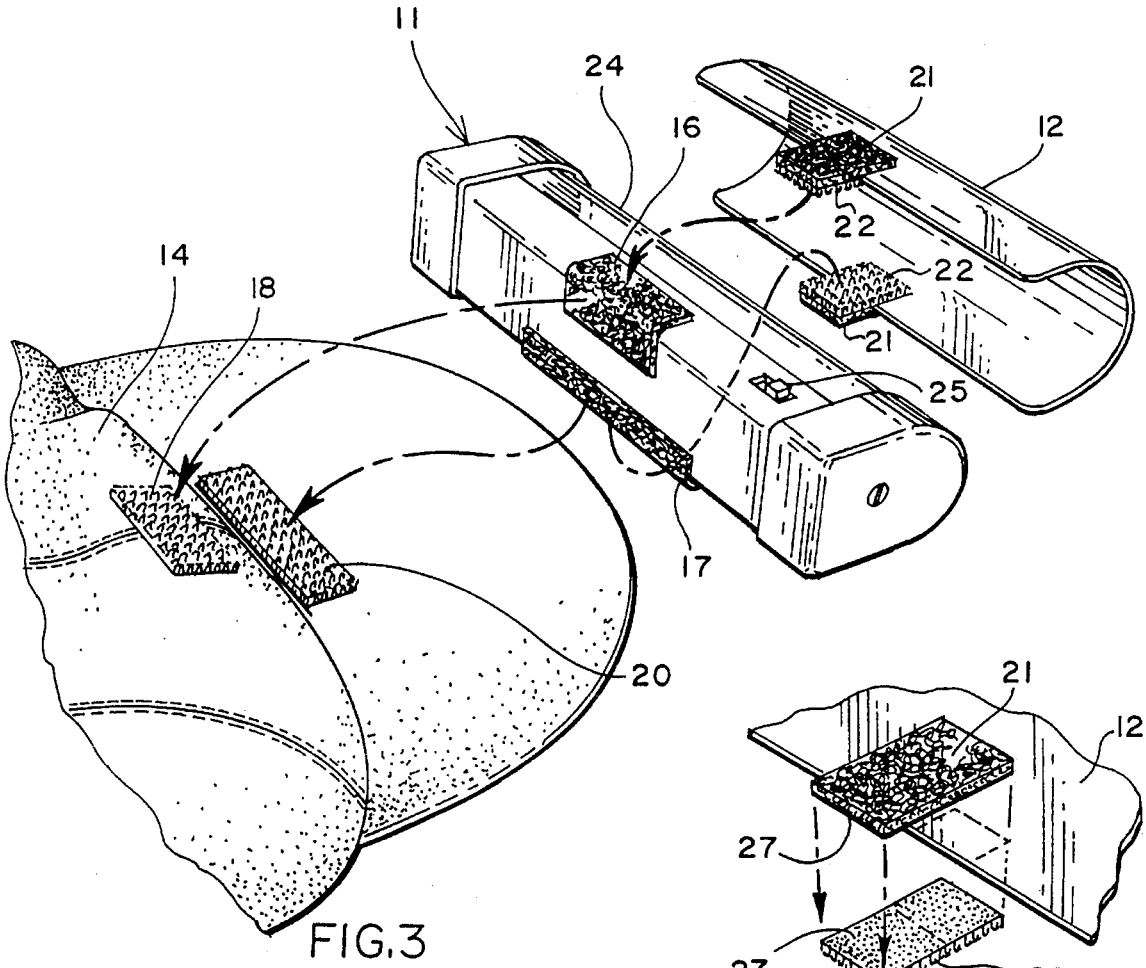
FIG. 3 illustrates in more detail the specific method for attaching each separate and removable member.

FIG. 3 illustrates the transparent shield 12 with the centrally positioned and opposingly attached segments of loops 21 to hooks 22 at both the top and bottom. Both segments of hooks are partially attached inside the shield 12 to engage the segment of loops 16 and the segment of loops 17, while the segment of loops 21 is outside the shield to engage the segment of hooks 20 sewn to the bill 15 of the cap 13, as demonstrated in FIG. 2.

FIG. 3 also demonstrates the position of the switch 25, which is positioned free from the attachment of the shield 12 to the light 11.

Further illustrated in FIG. 3 is the approximate length of each segment of loops and hooks. It will be noted that the segment of hooks 20 sewn to the bill of the cap 13 is shorter then the segment of loops 17 attached to the light 11. Similarly, the segment of hooks 18 sewn to the crown of the hat 14 is shorter then the segment of loops 16 attached to the light 11. Experience has shown that with repeated removal of the light from the cap 13, separation of the adhesively attached loops from the body of the light may occur unless the segment of hooks is shorter then the segment of loops.

The shield 12 serves to protect the lens 23 of the light 11. In addition, the transparent shield 12 may contain various colored pigments or other components. An example would be a red pigment which would preserve night vision by protecting the rods and cones of the retina of airplane pilots, yet still provide sufficient illumination with which to read instruments. It could also be used, for example, in film developing enclosures.

Figure 4:
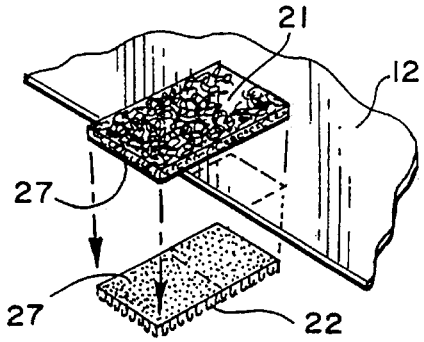
FIG. 4 illustrates the method of forming a single member 28 which serves to attach to and remove the shield 12 from the light 11.

FIG. 4 demonstrates the method for partially adhering the segment of hooks 22 to the inside of the shield 12, and the segment of loops 21 to the outside of the shield 12, so that a combined member 27 results. This member 27, as illustrated in FIG. 2 and FIG. 3, permits the shield 12 to be attached or removed from the light 11. While the aforegoing describes the invention in some detail, other variations of the concept would still belong within the scope of the claims.

What is claimed is:

1. A lighting apparatus for illuminating darkness which comprises:

a cap having a crown and a bill;

said cap having a first series of fixedly attached hooks engaged to said crown and said bill; and a fluorescent lighting device having a second series of fixedly attached hooks which is removably attached to said first series of fixedly attached hooks.

2. The lighting apparatus as defined in claim 1, further comprising:

a lens cover having a third series of fixedly attached hooks which is removably attached to said first series of fixedly attached hooks.

3. The lighting apparatus as defined in claim 2, wherein said lens cover may be pigmented red to obstruct certain wave lengths of light.

4. The lighting apparatus as defined in claim 1, wherein said first series of fixedly attached hooks on said cap are shorter then said second series of fixedly attached hooks on said lighting device.

5. The lighting apparatus as defined in claim 1, wherein said first series of fixedly attached hooks are mounted to said cap by sewing means.

6. The lighting apparatus as defined in claim 1, wherein said second series of fixedly attached hooks are mounted to said lighting device by adhesive means.

* * * * *